US008123612B2

(12) United States Patent
Yoshizawa

(10) Patent No.: US 8,123,612 B2
(45) Date of Patent: Feb. 28, 2012

(54) GAME SYSTEM

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 436 days.

(21) Appl. No.: 12/398,701

(22) Filed: Mar. 5, 2009

(65) Prior Publication Data

US 2009/0227355 A1 Sep. 10, 2009

Related U.S. Application Data

(60) Provisional application No. 61/034,653, filed on Mar. 7, 2008.

(51) Int. Cl.
*A63F 9/24* (2006.01)

(52) U.S. Cl. ..... 463/20; 463/25

(58) Field of Classification Search ..... 463/20, 463/25

See application file for complete search history.

(56) References Cited

U.S. PATENT DOCUMENTS 6,224,484 B1 5/2001 Okuda et al.
7,056,215 B1 6/2006 Olive
7,727,068 B2 * 6/2010 Peterson ..... 463/25
2006/0009283 A1 * 1/2006 Englman et al. ..... 463/29
2006/0094495 A1 * 5/2006 Gelber et al. ..... 463/20
2006/0166731 A1 * 7/2006 Yoshimi et al. ..... 463/20
2007/0167217 A1 * 7/2007 Kaminkow et al. ..... 463/20

* cited by examiner

*Primary Examiner* — Khiem D Nguyen
(74) *Attorney, Agent, or Firm* — NDQ & M Watchstone LLP

(57) ABSTRACT

A game system according to the present invention includes a plurality of slot machines and a common game machine. The plurality of slot machines each includes: a display having a symbol display region for displaying plural types of symbols in a matrix form; a memory for cumulatively storing bonus points in the case where the specific symbol is rearranged under a specific condition; and a controller. The common game machine is provided in common to the plurality of slot machines. The common game machine has: a common display device having a symbol display region for displaying plural types of symbols in a matrix form; a common memory for cumulatively storing a part of credit having been bet; and a common controller for selecting a column or row of a matrix displayed on the display device of each of the slot machines and rearranging, on the common display device, the symbol to be rearranged in the column or row. The common controller selects the slot machine possessing the bonus points, and executes the bonus game on the common display device. The common controller subtracts the bonus points of each of the slot machines every time the bonus game is executed, and executes the bonus game until the bonus points become zero. The common controller awards a prize determined based on a cumulative value of the credit stored in the common memory, in the case where a predetermined condition is met.

6 Claims, 13 Drawing Sheets

GAME SYSTEM

CROSS-REFERENCE TO RELATED APPLICATIONS

This application claims priority of U.S. Provisional Application No. 61/034,653 filed on Mar. 7, 2008. The contents of this application are incorporated herein by reference in their entirety.

BACKGROUND OF THE INVENTION

1. Field of the Invention

The present invention relates to a game system made up of a plurality of slot machines.

2. Description of the Related Art

Slot machines known as a type of gaming machines are constituted so as to: start games by players inserting coins or the like into the gaming machine; rearrange columns of symbols in predetermined region of the gaming machine; and award a prize based on a combination of rearranged symbols. In addition, the above slot machines are generally constituted to judge whether or not a winning combination allowed to award a prize is established, based on whether or not a predetermined number of symbols of the same type (for example, "CHERRY" or "7") are arranged along a preset payline. In the conventional slot machine, in the case where a predetermined number or more of symbols of the same type are arranged, it has been a common routine to award a prize based on the number of the aforementioned arranged symbols, regardless of the payout line.

Further, a bonus prize is set that is awarded in the case where a combination of symbols is rearranged in a specific order, in which a big prize, namely, so-called jackpot is awarded, thereby enhancing entertainability of the slot machine. The possibility of winning this jackpot, however, is kept low. Therefore, there is an aspect that players consider the jackpot as no more than an accidentally-winnable prize.

In a conventional slot machine, each of the slot machines executes a game independently, so that a plurality of players cannot enjoy as a group the game with the use of the plurality of slot machines. U.S. Pat. No. 7,056,215-B1, for example, discloses a game system that the plurality of game machines and a jackpot controller are connected via a network. In this system, the jackpot controller controls each of the game machines with respect to a trigger of a bonus game and a payout amount of the jackpot. However, the fact remains that the game itself is executed in each of the game machines.

U.S. Pat. No. 6,224,484 discloses a game system including the plurality of game machines and a progressive unit. In this system, a progressive bonus is paid out to one out of the plurality of game machines that won a prize during a main game. A game to determine the single game machine is executed in each of the game machines or the progressive unit but these game machines are not associated with each other, which does not fit the purpose that players enjoy a game as a group.

The present invention has been made in view of the above-described circumstance. It is an object of the present invention to provide a novel game system and a controlling method thereof that control a game so players are able to have expectations for the establishment of the jackpot to enhance entertainability and that execute a common game among the plurality of slot machines.

SUMMARY OF THE INVENTION

A first aspect of the present invention is a game system including a plurality of slot machines and a common game machine for executing a predetermined bonus game in connection with a game executed among the plurality of slot machines. The plurality of slot machines each has: an input device for accepting BET; a display device having a symbol display region for displaying plural types of symbols in a matrix form; a memory for cumulatively storing bonus points in the case where a specific symbol from among the plural types of symbols is rearranged in the symbol display region under a specific condition; a controller for executing processes for accepting the BET input through the input device, rearranging the plural types of symbols in the symbol display region of the display device, and cumulatively storing the bonus points in the memory. The common game machine has: a common display device provided in common to the plurality of slot machines, the common display device having a symbol display region for displaying plural types of symbols in a matrix form; a common memory for cumulatively storing a part of credit bet through the input device; and a common controller for selecting a column or row of a matrix displayed on the display device of each of the slot machines and rearranging, on the common display device, the symbol to be rearranged in the column or row by means of the common controller. The common controller selects the slot machine possessing the bonus points; executes the bonus game on the common display device; subtracts a predetermined number from the bonus points stored in the memory of each of the slot machines, every time the bonus game is executed; and awards a prize determined based on a cumulative value of the credit stored in the common memory, in the case where a predetermined condition is met during the bonus game.

According to the first aspect of the present invention, when the specific symbol is rearranged under the specific condition while the game is executed in each of the slot machines, bonus points are cumulated and stored in each of the slot machines and the right to participate in the bonus game the equal number of times to a cumulative value of the bonus points is endowed. Therefore, players can play the game with expectation that the jackpot might be awarded in the bonus game executed in the common game machine.

A second aspect of the present invention is a game system constituted as set fourth below. In the first aspect, the common controller rearranges in the symbol display region of the common display device the symbols to be rearranged in the selected row or column while the symbols are rearranged in the display device of each of the slot machines.

According to the second aspect of the present invention, the display device of each of the slot machines and the common display device proceed the game in sync with each other, which makes it more recognizable that the game rearranged in the common display device is a common game.

A third aspect of the present invention is a slot machine constituted as set forth below. In the first aspect, the common controller determines allotment of payout to each of the plurality of slot machines, based on a cumulative value of the bonus points stored in each of the memories.

According to the third aspect of the present invention, in the case where there are the plurality of slot machines that win the jackpot, the identical prizes may be awarded. However, the entertainability can be further enhanced by exercising control so as to award higher payout to the slot machine that won higher bonus points.

DESCRIPTION OF THE PREFERRED EMBODIMENTS

A game system according to the present invention will be explained in details with reference to the drawings. A plurality of slot machines 10*a* to 10*e* and a common game machine 75 configuring a game system 1 shown in FIG. 1 according to the present invention are so-called video slot machines, each of which has an image display panel such as a liquid crystal display and executes a game by displaying images of various symbols on the image display panel. The plurality of slot machines 10*a* to 10*e* according to the present invention executes two gaming modes alternately. The two gaming modes include a basic game and a free game. The basic game is executed upon consumption of gaming values bet by players, namely, credit. The free game is executed without consuming the credit. On the other hand, the common game machine 75 is connected to the network in common with the respective slot machines so that players of the slot machines can execute the common game through the common game machine.

Figure 1:
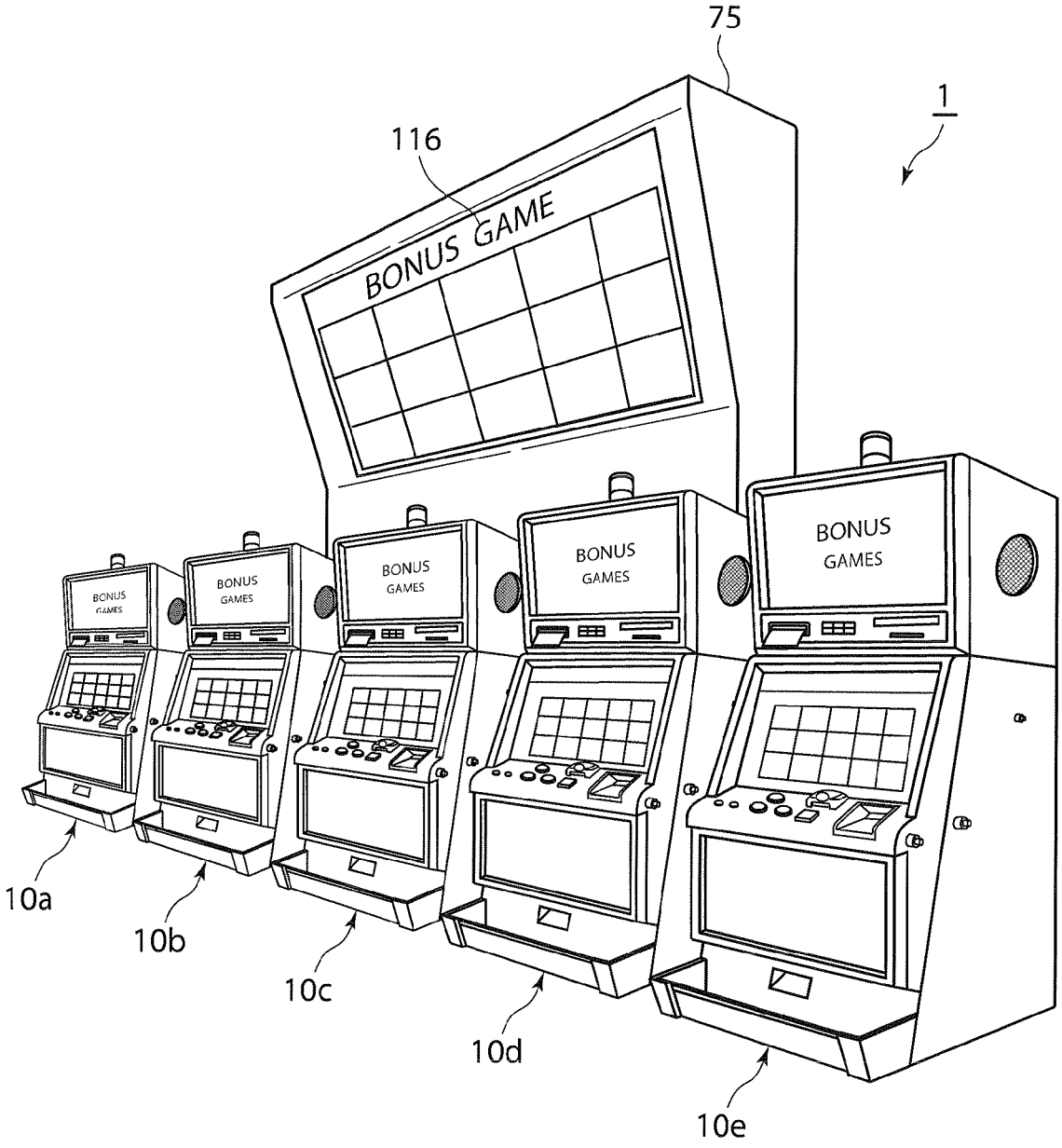
FIG. 1 is a perspective view schematically showing a common game machine and a plurality of slot machines configuring a game system.

The common game machine 75 as shown in FIG. 1 displays the symbol matrix with three rows and five columns in a display region. A common controller of the common game machine 75 designates one column of the symbol matrix with three rows and five columns displayed in the display region of each of the five slot machines 10*a* to 10*e*. The common controller then rearranges the same symbols as those displayed in the above one column, in one column of a matrix with three rows and five columns displayed in the display device of the common game display 75. Specifically, the symbol matrix with three rows and five columns displayed in the display device of the common game is made up of five single columns which are respectively collected from the symbol matrices of the five slot machines 10*a* to 10*e*. In the case where the above common controller designates a row of the symbol matrix of each of slot machine, three of the five slot machines 10*a* to 10*e* are designated, and symbols to be rearranged in the single row of the symbol matrix of each of the designated slot machines are collected on the symbol matrix of the common game machine 75. According to this game system, the players can enjoy respective games through the slot machines while enjoying the common game executed in the common game machine 75.

According to the first embodiment of the present invention, during the basic games, that are executed independently in the respective slot machine 10*a* to 10*e*, in the case where specific symbols are rearranged in a manner to satisfy a predetermined condition, the common controller awards a bonus point as a right to participate in a bonus game executed in the common game machine 75, and then executes the bonus game in a state where the respective slot machines cumulate and hold bonus points. Further, the common controller awards the jackpot when the bonus symbol is arranged in the symbol matrix of the common game machine 75 under a predetermined condition during the bonus game.

Figure 2:
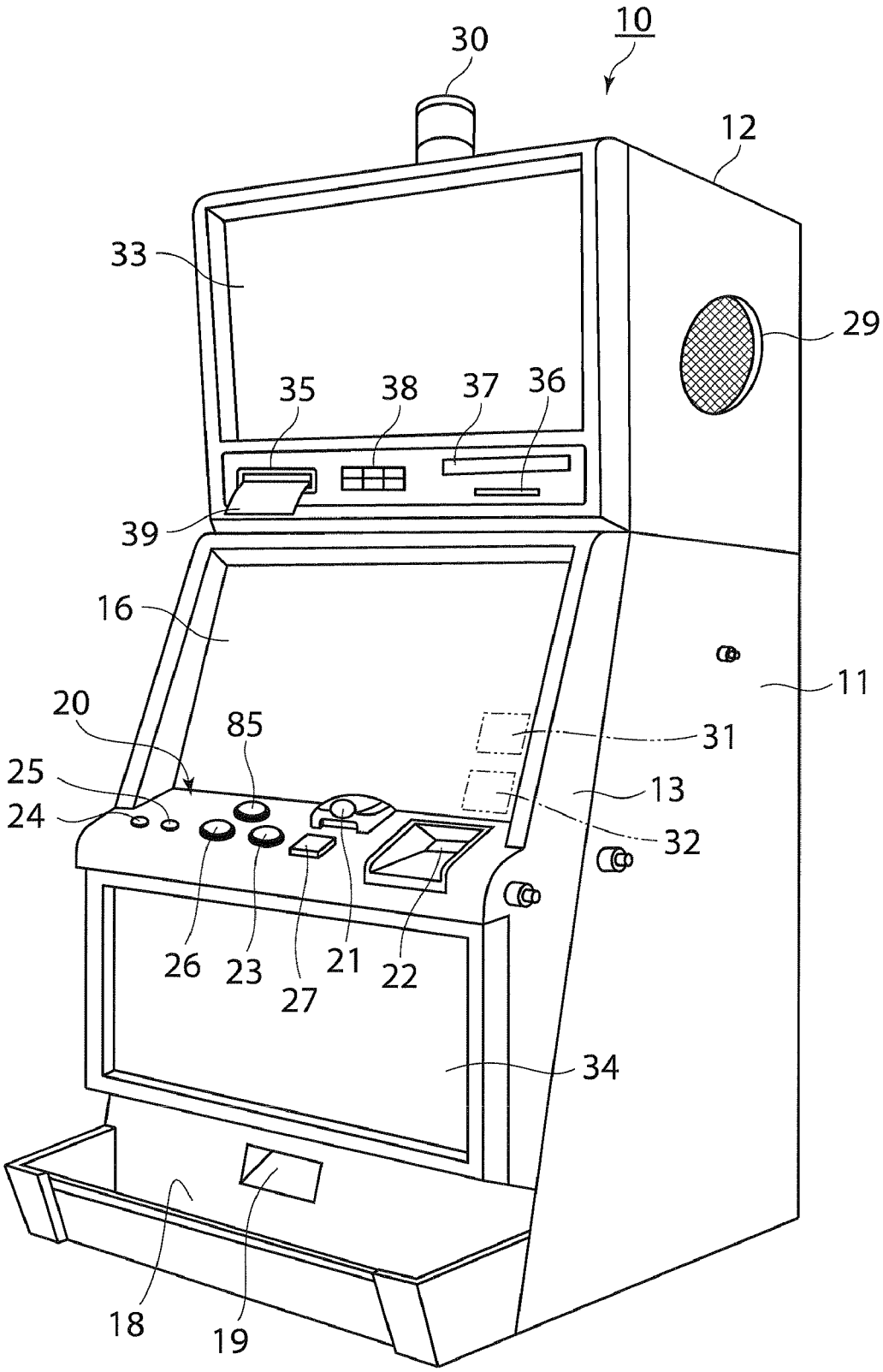
FIG. 2 is a perspective view schematically showing an appearance of a slot machine according to the first embodiment.

FIG. 2 is a view schematically depicting an appearance of the slot machine according to the first embodiment. The gaming media used in the slot machine 10 include coins, bills, or electronic value information equivalent thereto. In the present invention, however, the gaming media are not limitative thereto in particular, and can include medals, tokens, electric money, and tickets, for example. The above tickets are not limitative in particular, and can include barcode-attached tickets or the like, as described later, for example.

The slot machine 10 is provided with a cabinet 11, a top box 12 installed on an upper side of the cabinet 11, and a main door 13 provided on a front surface of the cabinet 11.

The lower image display panel 16 serving as a display device is provided in front of the main door 13. The lower image display panel 16 is provided with a liquid crystal panel, which displays the cells of the symbol matrix 28 in three rows and five columns. A single symbol is arranged in each of the cells of the symbol matrix 28, and the maximum of fifteen symbols can be displayed.

A credit amount display section 31 of the lower image display panel 16 displays credit corresponding to the number of inserted coins by way of an image. A payout amount display unit 32 displays by way of an image, a combination of rearranged symbols or the number of coins to be paid if the predetermined number of symbols are rearranged.

Provided on a lower side of the lower image display panel 16 at a center of the main door 13 is a control panel 20 on which a plurality of buttons 23 to 27 and 85 through which command regarding the process of the game is entered, a coin receiving slot 21 for receiving coins into the cabinet 11, and bill validator 22 are disposed.

On the control panel 20, a start button 23, a change button 24, a cashout button 25, a 1-BET button 26, a MAX-BET button 27, and a side-BET button 85 are provided. The start button 23 is intended for entering a command for starting the game. The change button 24 is intended for use in asking an attendant of the gaming facility for change. The cashout button 25 is intended for entering a command for paying out the credited coins to a coin tray 18 through a coin payout exit 19.

The 1-BET button 26 is intended for entering a command for betting credit corresponding to one coin. The MAX-BET button 27 is intended for entering a command for betting the maximum number (fifty in this embodiment) of coins that can be bet per game. The side-BET button 85 is used to place a bet on a sub game other than a game in which symbols are rearranged in the symbol matrix 28. In this embodiment, for example, control can be performed to rearrange the symbol "CHANCE 70*a*" in the symbol matrix 28 when the predetermined credit is bet by the side-BET button 85. A part of credit that has been bet through those input units are cumulatively stored in a memory region provided in a RAM 43 and are used as the reference to determine the amount of payout in the case where the jackpot is won during the bonus game.

The bill validator 22 validates whether or not a bill is legitimate and accepts a legitimate bill into the cabinet 11. The bill validator 22 may be configured so that a barcode-attached ticket 39 described later is readable thereby. Provided on a lower front surface of the main door 13, that is, at a lower part of the control panel 20, is a berry glass 34 on which characters of the slot machine 10 and the like are depicted.

On a front surface of the top box 12, an upper image display panel 33 is provided. The upper image display panel 33 has a liquid crystal panel, which displays images for introducing the game contents or explaining game rules, for example.

Also, on the top box 12, a speaker 29 and a lamp 30 are provided. On a lower side of the upper image display panel 33, a ticket printer 35, a card reader 36, a data display unit 37, and a key pad 38 are provided. The ticket printer 35 prints on the ticket, a barcode having encoded thereon data such as the credit amount, the date and time, and the identification number of the slot machine 10, and outputs the printed ticket as the barcode-attached ticket 39. The player can play the game on another slot machine with the barcode attached ticket 39 by causing this slot machine to read the barcode attached ticket 39. Alternatively, the player can exchange the barcode-attached ticket 39 with the bills or the like at a predetermined place (at a cashier inside a casino, for example) of the gaming facility.

The card reader 36 reads data from and writes data into a smart card. The smart card is to be owned by the player, which stores data for identifying the player or data regarding the log of games executed by the player, for example. The smart card may store data corresponding to coins, bills, or credit. As an alternative of a smart card, a magnetic stripe card may be employed. The data display 37 is made up of a fluorescent display and the like, and displays the data read by the card reader 36 or the data input by the player through the key pad 38, for example. The key pad 38 inputs data and commands regarding the ticket issuance or the like.

Figure 3A:
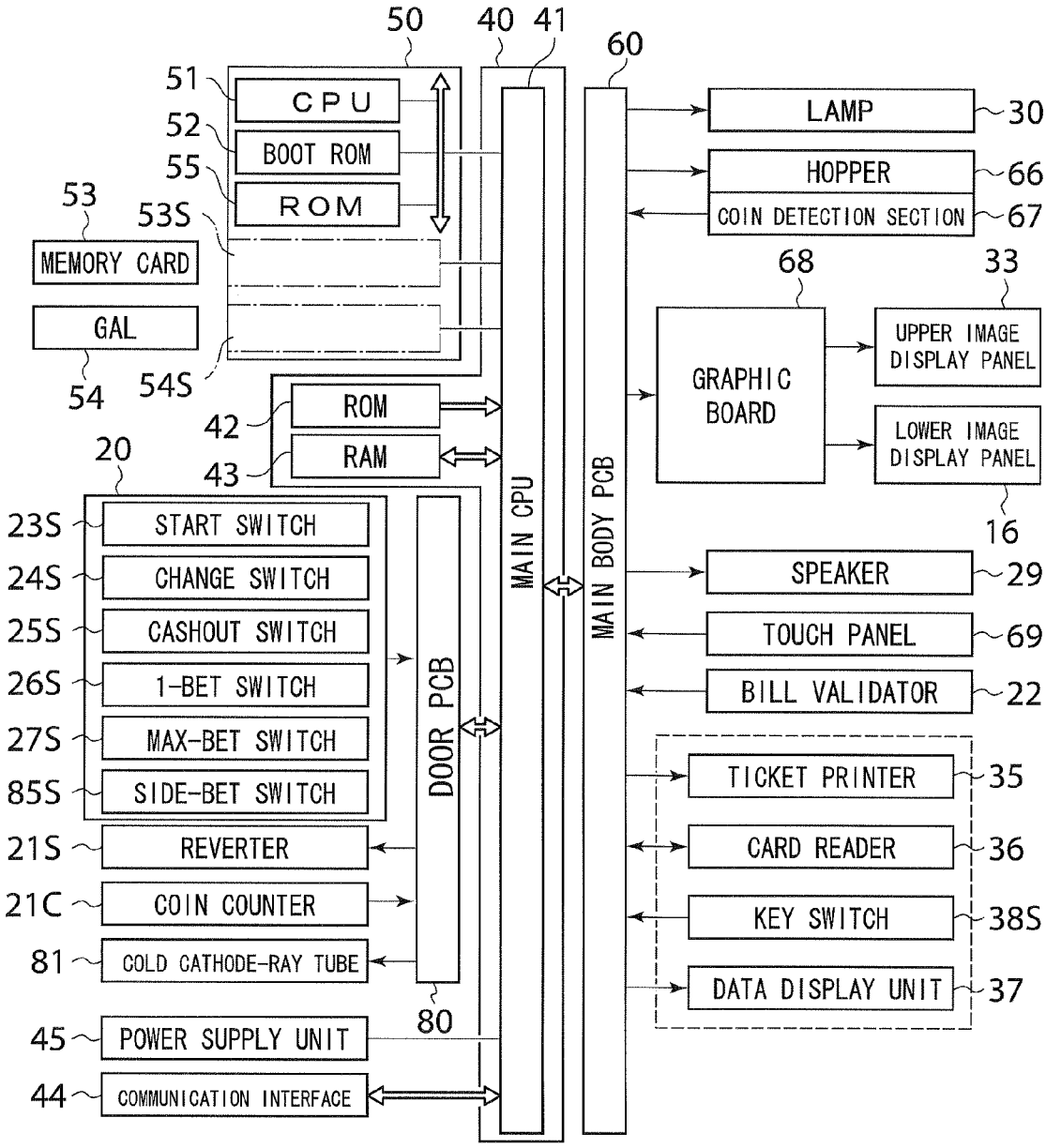
FIG. 3A is a block diagram depicting an internal construction of the slot machine shown in FIG. 2.

FIG. 3A is a block diagram depicting the internal construction of the slot machine shown in FIG. 2. A gaming board 50 includes: a CPU (Central Processing Unit) 51, a ROM (Read Only Memory) 55 and a boot ROM 52 interconnected by an internal bus; a card slot 53S corresponding to a memory card 53; and an IC socket 54S corresponding to a GAL (Generic Array Logic) 54.

The memory card 53 contains therein a nonvolatile memory and stores game programs. The game programs include a symbol selection program. The aforementioned symbol selection program is intended for determining the symbols to be rearranged in the symbol matrix SM. The aforementioned symbol selection program includes symbol weighing data respectively corresponding to plural types of payout ratios (80%, 84%, and 88%, for example). The symbol weighting data is indicative of the correspondence relationship between the respective symbols and one or more random numeric values which come under a predetermined numerical range (0 to 255). The payout ratio is determined according to the payout-ratio setting data output from the GAL 54. The symbols to be rearranged in the symbol matrix 28 are determined depending upon the symbol weighing data corresponding to this payout ratio. Further, the game programs include table data indicating the correspondence relationship between each of the symbols and a payout.

Also, the card slot 53S is configured to allow the memory card 53 to be inserted thereinto or ejected therefrom, and is connected to a motherboard 40 through IDE pass. Accordingly, the memory card 53 can be ejected from the card slot 53S, other game programs and other game system programs can then be written into the memory card 53, and further, the memory card 53 can be inserted into the card slot 53S, thereby allowing the player to change the types and contents of games executed in the slot machine 10. The game program includes data concerning a game progress. Furthermore, the game program includes image data or sound data to be output during the game. The image data include, for example, image data indicative of the symbol matrix 28.

The GAL 54 is a type of a PLD having a fixed OR array structure. The GAL 54 includes plural input ports and plural output ports. Where predetermined data is input to the input port, the GAL 54 outputs data corresponding to the aforementioned data from the output port. The data output from this output port is equivalent to the aforementioned payout-ratio setting data. Further, the IC socket 54S is configured to allow the GAL 54 to be attached thereto and detached therefrom, and is connected to the motherboard 40 by a PCI bus. Accordingly, the GAL can be replaced with the replacement GAL 54 to change the payout-ratio setting data.

The CPU 51, the ROM 55, and the boot ROM 52 interconnected by the internal bus are connected to the motherboard 40 by the PCI bus. The PCI bus serves to transmit signals between the motherboard 40 and the gaming board 50 and supply power from the motherboard 40 to the gaming board 50.

The motherboard 40 is constructed using a general-purpose motherboard commercially available (a printed circuit board on which essential parts of a personal computer are mounted) and includes: a main CPU (Central Processing Unit) 41, a ROM (Read Only Memory) 42; a RAM (Random Access Memory) 43; and a communication interface 44.

The ROM 42 stores thereon a program such as BIOS (Basic Input/Output System) executed by a main CPU 41, and permanent data. When the BIOS is executed by the main CPU 41, processing of initializing predetermined peripheral devices is carried out and processing of capturing game programs and game system programs stored in the memory card 53 through the gaming board 50 is started. In the present invention, the contents of the ROM 42 may be rewritable or not.

The RAM 43 stores data and a program used when the main CPU 41 is activated. The RAM 43 can also store game programs. The RAM 43 further stores data concerning the credit amount, the number of coin-in or coin-out for one game, and the like. In embodiments of the present invention, the RAM 43 stores bonus points cumulatively.

Both a main body PCB (Printed Circuit Board) 60 and a door PCB 80 are connected to the motherboard 40 by USB. A power supply unit 45 is also connected to the motherboard 40.

Connected to the main body PCB 60 and the door PCB 80 are: equipment and devices which generate input signals to be input to the main CPU 41; and equipment and devices of which operations are controlled by a control signal output from the main CPU 41. The main CPU 41 executes a game program stored in the RAM 43 based on an input signal having been input to the main CPU 41 and performs a predetermined computational process, thereby storing results thereof in the RAM 43 or transmitting a control signal to each of equipment and devices as a control process therefor.

A lamp 30, a hopper 66, a coin detecting section 67, a graphic board 68, a speaker 29, a touch panel 69, the bill validator 22, the ticket printer 35, the card reader 36, a key switch 38S, and the data display unit 37 are connected to the main body PCB 60. The lamp 30 is lit up in a predetermined pattern based on a control signal output from the main CPU 41.

The hopper 66 is installed in the cabinet 11 and pays out a predetermined number of coins from the coin payout exit 19 to the coin tray 18 based on a control signal output from the main CPU 41. The coin detecting section 67 is installed inside the coin payout exit 19 and outputs an input signal to the main CPU 41 upon detecting that a predetermined number of coins have been paid out from the coin payout exit 19.

The graphic board 68 controls, based on a control signal output from the main CPU 41, images to be displayed on the upper image display panel 33 and the lower image display panel 16. The credit amount stored in the RAM 43 is displayed on a credit amount display section 31 (see FIG. 2) of the lower image display panel 16. The number of coins to be paid out is displayed at a payout amount display section 31 (see FIG. 2) of the lower image display panel 16. The graphic board 68 is equipped with a VDP (Video Display Processor) which generates image data based on a control signal output from the main CPU 41 and a video RAM which temporarily stores image data generated by the VDP, and the like. The image data used in generating image data with VDP is contained in the game program read from the memory card 53 and stored in the RAM 43.

The bill validator 22 validates whether or not a bill is legitimate and accepts a legitimate bill into the cabinet 11. Upon accepting a legitimate bill, the bill validator 22 outputs an input signal to the main CPU 41 based on the amount of the bill. The main CPU 41 stores in the RAM 43 the credit amount corresponding to the amount of bills transmitted by the input signal.

Based on a control signal output from the main CPU 41, the ticket printer 35 prints on a ticket a barcode having encoded thereon data such as the credit amount, data and time, and the identification number of the slot machine 10 stored in the RAM 43. Further, this printer outputs the printed ticket as a barcode-attached ticket 39. The card reader 36 transmits to the main CPU 41 the data read from the smart card and writes the read data onto the smart card, based on a control signal from the main CPU 41. The key switch 38S is provided on the key pad 38, and outputs a predetermined input signal to the main CPU 41 when the player operates the key pad 38. The data display 37, based on a control signal output from the main CPU 41, displays the data read by the card reader 36 and the data input by the player through the key pad 38.

The control panel 20, a reverter 21S, a coin counter 21C, and a cold cathode tube 81 are connected to the door PCB 80. The control panel 20 is provided with: a start switch 23S corresponding to the start button 23; a change switch 24S corresponding to the change button 24; a cashout switch 25S corresponding to a cashout button 25; a 1-BET switch 26S corresponding to a 1-BET button 26; a MAX-BET switch 27S corresponding to the MAX-BET button 27; and a side-BET switch 90S corresponding to the side-BET switch 85. When the player operates the buttons 23 to 27 and 85, the corresponding switches 23S to 27S and 90S output input-signals to the main CPU 41, respectively.

The coin counter 21C is provided inside the coin receiving slot 21, and validates whether or not a legitimate coin is inserted into the coin receiving slot 21. Those other than the legitimate coins are discharged from the coin payout exit 19. The coin counter 21C outputs an input signal to the main CPU 41 when a legitimate coin is detected.

The reverter 21S operates based on a control signal output from the main CPU 41 and distributes coins recognized as being legitimate by the coin counter 21C into a cash box (not shown in the drawings) or the hopper 66 which is arranged in the slot machine 10. In other words, when the hopper 66 is filled with coins, legitimate coins are distributed by the reverter 21S into the cash box. On the other hand, when the hopper 66 is not filled with coins, legitimate coins are distributed into the hopper 66. The cold cathode tube 81 functions as a backlight installed on rear face side of each of the lower image display panel 16 and the upper image display panel 33, and is lit up based on a control signal output from the main CPU 41.

Figure 3B:
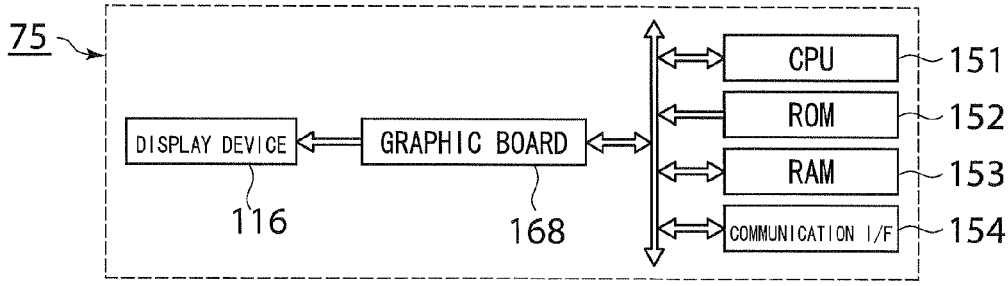
FIG. 3B is a block diagram depicting an internal construction of the common game machine shown in FIG. 1.

FIG. 3B is a block diagram depicting an internal construction of the common game machine 75 shown in FIG. 1. The common game device 75 includes a communication I/F 154 for conducting communication between the respective slot machines 10*a* to 10*e* and the main CPU 41, a RAM 153, a ROM 152, a CPU 151 functioning as a common controller, and a graphic board 168 for displaying images by controlling a display device 116.

The ROM 42 stores thereon a program such as BIOS (Basic Input/Output System) executed by the CPU 151, and permanent data. When the BIOS is executed by the CPU 151, processing of initializing predetermined peripheral devices is carried out and the RAM 153 reads a control program of the common game machine 75 and a game system program. The RAM 43 stores data related to a game, such as a cumulative value of credit possessed by each of the slot machines or bonus points. The graphic board 168 controls images displayed in the display device 116 based on a control signal output from the main CPU 151.

Figure 4A:
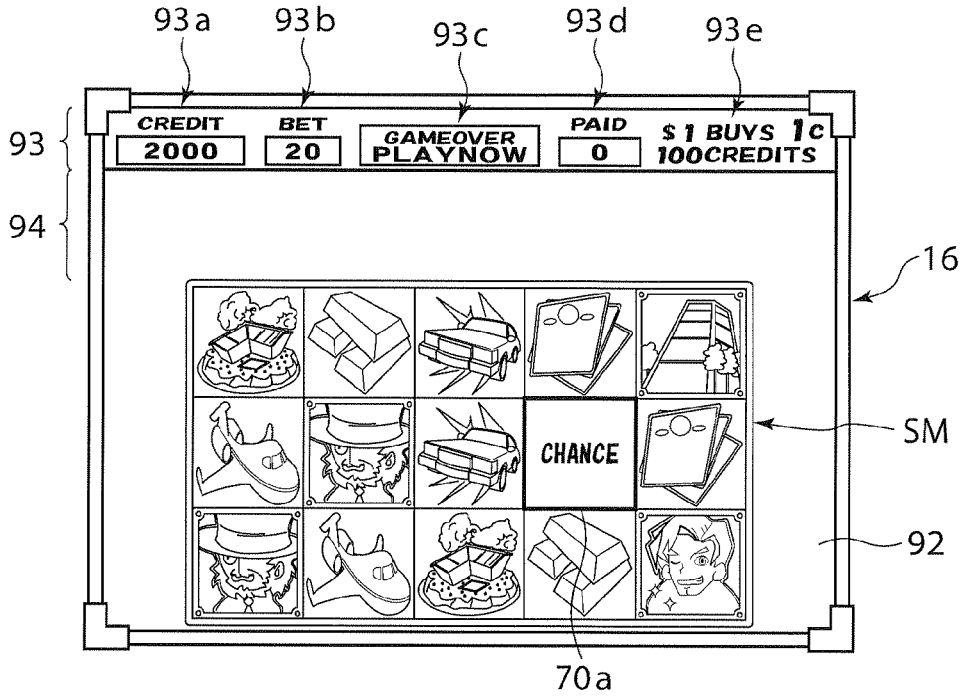
FIG. 4A is a view showing an exemplary symbol matrix displayed during the basic game in the slot machine shown in FIG. 2.

FIGS. 4A to 9B are views each showing an exemplary image displayed on an image display panel 16 of the slot machine 10 shown in FIG. 2 according to the first embodiment. FIGS. 4A and 4B are views each showing an exemplary image displayed during a basic game in the slot machine shown in FIG. 2.

As shown in FIG. 4A, the lower image display panel 16 is made up of a display region 92, an information display section 93, the effect image display section 94, and the like. The symbol matrix 28 is displayed in the display region 92. On both sides of the symbol matrix 28, the icons indicative of the number of coins that have been bet are arranged, and control is performed to blink the icon corresponding to the bet amount. The information display section 93 is arranged upwardly of the display region 92 and is made up of a credit amount display section 93*a*, a BET amount display section 93*b*, a character information display section 93*c*, a PAID amount display section 93*d*, and a charge display section 93*e*.

The number of coins currently credited is displayed at the credit amount display section 93*a* while the number of coins bet on one game is displayed at the BET amount display section 93*b*. The character information indicative of a current status of the game is displayed at the character information display section 93*c*. The characters of "PLAYNOW" are displayed during the play of the game, whereas the characters of "GAMEOVER" are displayed during the intervals between the plays of the game. The number of coins that have been paid out in one game is displayed at the PAID amount display section 93*d*, whereas a conversion value of the credit amount based on a predetermined amount of money is displayed at the charge display section 93*e*.

The effect image display section 94 displays effect images according to a type of the slot game. In other words, the effect image display section 94 displays different effect images between the basic and free games.

Any of symbols, "main character 121", "sub character 122", "office building 123", "gold bullion 124", "car 125", "stock certificate 126", "jet 127", "villa 128", and "CHANCE 70*a*" are rearranged in the elements of the symbol matrix displayed on the lower image display panel 16. A payout is determined based on the number of these symbols rearranged in the symbol matrix.

FIG. 4A is a view showing a case where the symbols, "main character 121", "sub character 122", "office building 123", "gold bullion 124", "car 125", "stock certificate 126", "jet 127", "villa 128", and "CHANCE 70*a*" are rearranged in the symbol matrix 28 during the basic game. The single symbol "CHANCE 70*a*" is rearranged, which does not meet the condition to win the bonus point, so that the icon "BONUS 70*d*" is not displayed in the effect image display section 94. On the other hands, the two symbols "main character 121" are displayed, each of which serves a trigger to switch the basic game to the free game. The condition to start the free game is met when three or more symbols "main character 121" are rearranged. This condition is not met in this case, thereby not starting the free game.

Figure 4B:
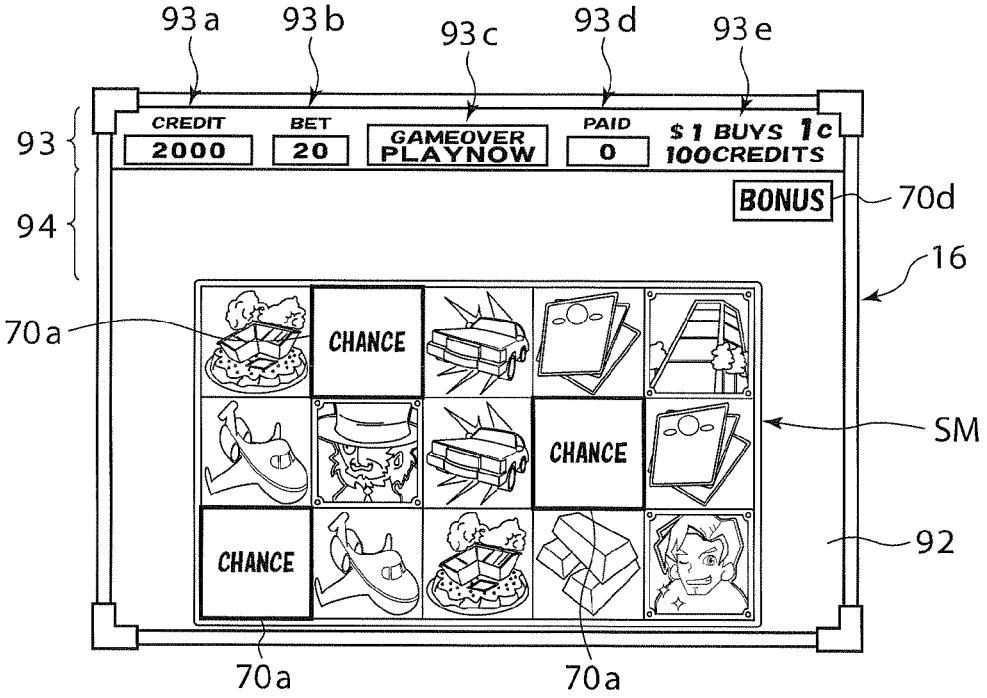
FIG. 4B is a view showing an exemplary symbol matrix displayed during the basic game in the slot machine shown in FIG. 2.

FIG. 4B also shows an exemplary symbol matrix displayed during the basic game, in which the symbols, "main character 121", "sub character 122", "office building 123", "gold bullion 124", "car 125", "stock certificate 126", "jet 127", "villa 128", and "CHANCE 70*a*" are rearranged in the symbol matrix 28 in three rows and five columns. In this exemplary case, the three symbols "CHANCE 70*a*" are rearranged. One bonus point is awarded when the three symbols "CHANCE 70*a*" are rearranged, and the icon "BONUS 70*d*" is displayed in an effect image display region 94 right above the symbol matrix (see FIGS. 4A and 4B). The bonus points are cumulatively stored in a storage area of the RAM 43, and a right is provided, that is to execute the bonus game by the equal number of times to the cumulative value.

Figure 5A:
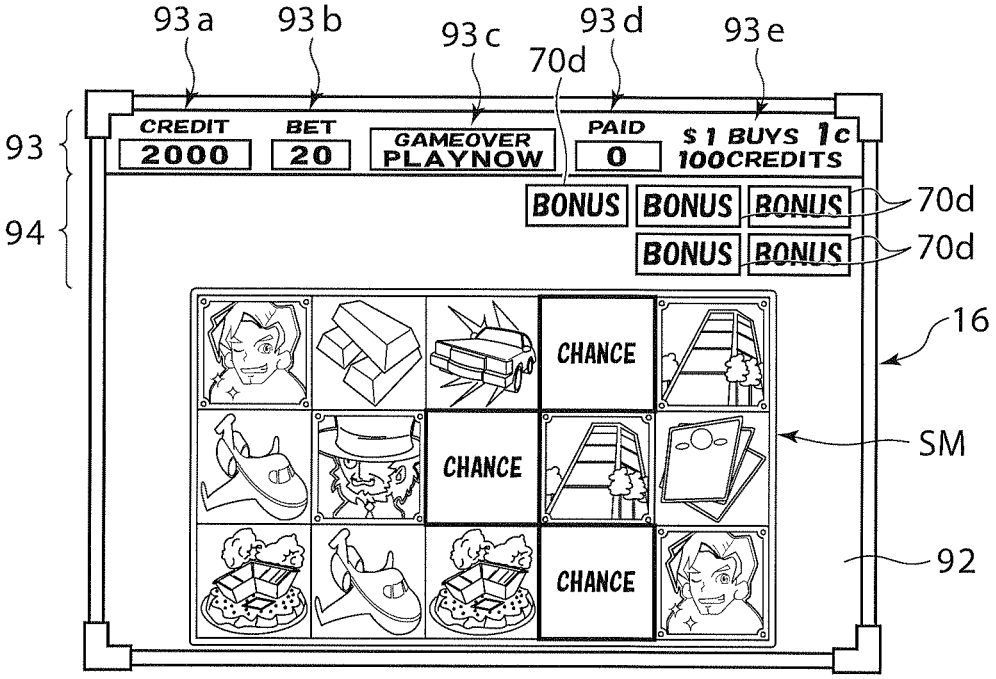
FIG. 5A is a view showing an exemplary symbol matrix displayed during the basic game in the slot machine shown in FIG. 2.

FIG. 5A is a view showing an exemplary symbol rearrangement in the symbol matrix 28 during the basic game, related to determination of start of the bonus game. Herein, the three symbols "CHANCE 70*a*" are rearranged in the symbol matrix 28. As a result, one more icon "BONUS 70*d*" is added. In FIG. 5A, the five icons "BONUS 70*d*" are displayed in the effect image display region 94, indicating that five bonus points are won. Therefore, the bonus game can subsequently be executed five times.

Figure 13:
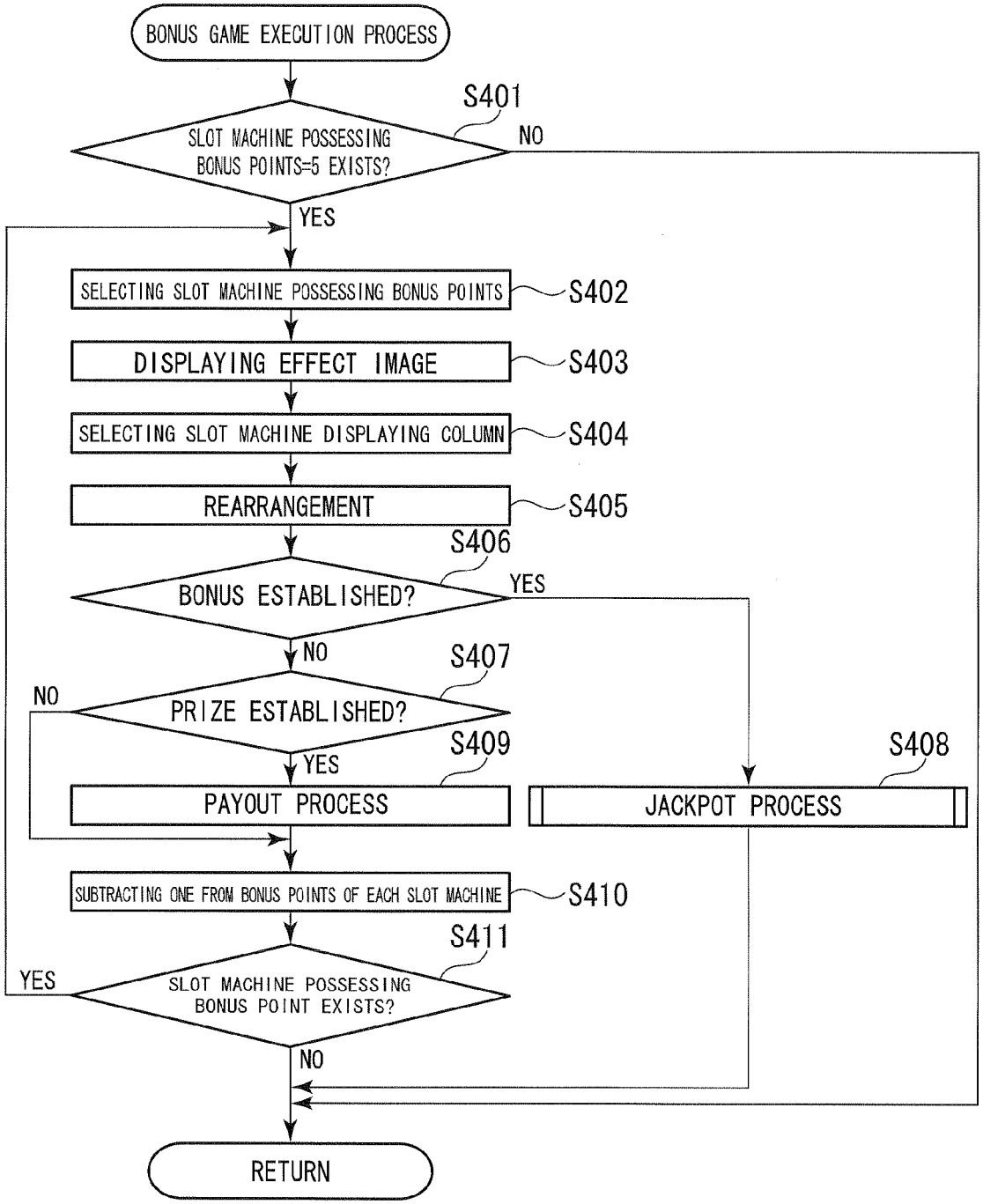
FIG. 13 is a flowchart showing a subroutine of a bonus game execution process according to the common game machine.

The CPU 151 as the common controller of the common game machine 75 starts the bonus game when any one of the slot machines 10*a* to 10*e* cumulates five bonus points (see FIG. 13). The slot machine shown in FIG. 5A wins five points, so that the CPU 151 executes the bonus game with the common game machine 75.

Figure 5B:
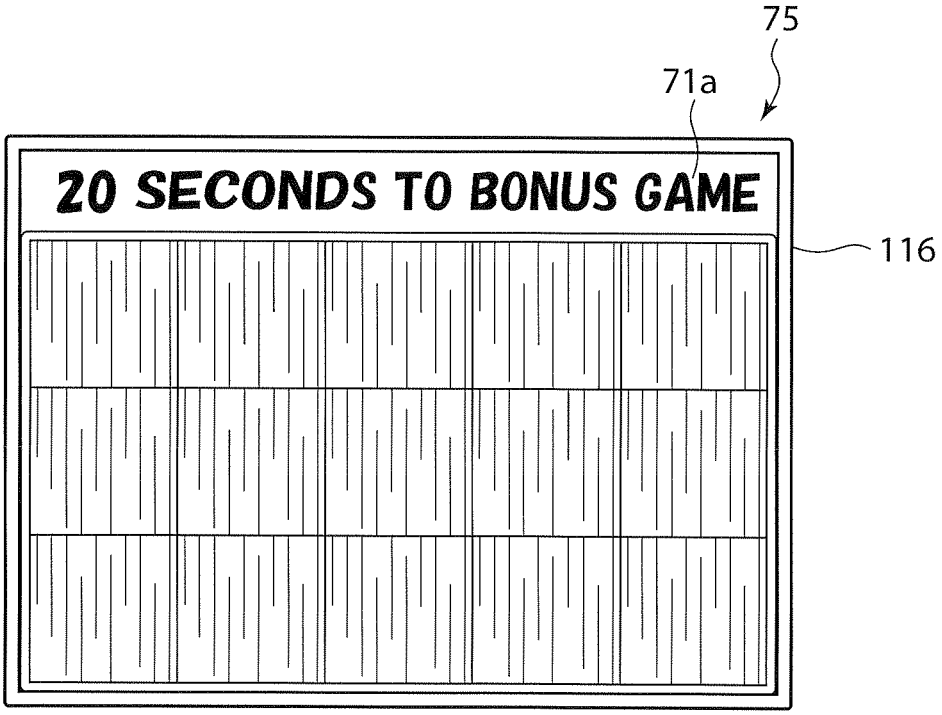
FIG. 5B is a view showing an exemplary symbol matrix displayed during the bonus game in the common game machine.

FIG. 5B is a view showing an exemplary image displayed in the display device of the common game machine 75 during the bonus game. In the case where start of the bonus game is determined, a display image 71*a* in FIG. 5B is displayed in the display device 116 of the common game machine 75 while a scrolling screen is displayed in the matrix display region of the display device 116. The display image 71 a indicates that the bonus game is started after twenty seconds.

Figure 6A:
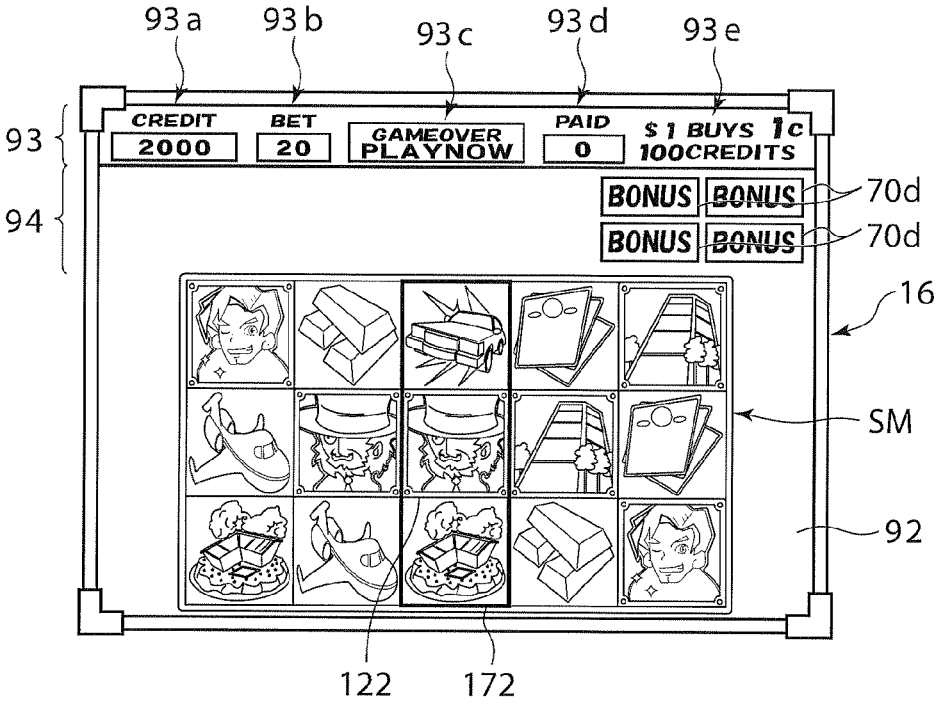
FIG. 6A is a view showing an exemplary image displayed during the bonus game in the slot machine shown in FIG. 2.

FIG. 6A is a view showing an exemplary image displayed in the lower image display panel 16 of the slot machine 10 during the bonus game. When the bonus game is started, the slot machines possessing the bonus points execute individually a symbol rearrangement game according to an instruction from the common controller CPU 151 of the common game machine 75. When a display image 71*a* in FIG. 5B is displayed in the display device 116 of the common game machine 75, players of the slot machines that participate in the bonus game are required to push the start button 23 in twenty seconds. When the start button 23 is pushed, in each of the slot machines, the main CPU 41 rearranges the symbols in the symbol matrix 28. In the case shown in FIG. 6A, the CPU 151 of the common game machine 75 designates a column 172 in FIG. 6A and rearranges in a column 100*e* of the symbol matrix displayed in the display device 116 of the common game machine 75, the symbols, "car 125", "sub character 122", and "villa 128" that are rearranged in the column 172 of the symbol matrix 28 shown in FIG. 6A. Selection of a column by the common controller CPU 151 is not fixed but determined at random just before rearrangement of symbols in each of the symbol matrices.

Figure 6B:
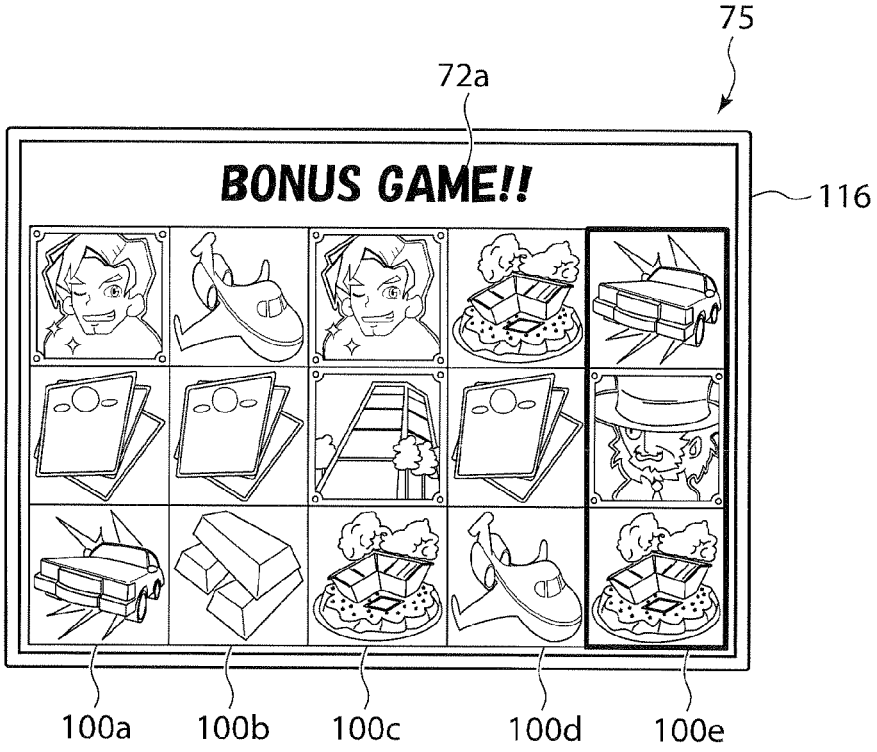
FIG. 6B is a view showing an exemplary image displayed during the bonus game in the common game machine.

FIG. 6B shows a view showing an exemplary image rearranged in the symbol matrix of the common game machine 75 during the bonus game. As described above, each of the symbols "car 125", "sub character 122", and "villa 128", that are rearranged in the column 172 of the symbol matrix 28 of the slot machine displaying a screen shown in FIG. 6A, is rearranged in the column 100*e*. The symbols that are rearranged in columns 100*a* to 100*d* are respectively the same as those rearranged in the symbol matrices of the different slot machines. In this case, three symbols "stock certificate 126" and three symbols "villa 128" are rearranged in the symbol matrix rearranged in the display device 116 of the common game machine 75, and a corresponding payout is awarded as an outcome of the common game to each of the slot machines that participate in the bonus game. In the symbol matrix 28 of the slot machine shown in FIG. 6A, no prizes are established, so that a payout is not awarded as an outcome of the game executed in the individual slot machine but awarded as an outcome of the common game.

Figure 7:
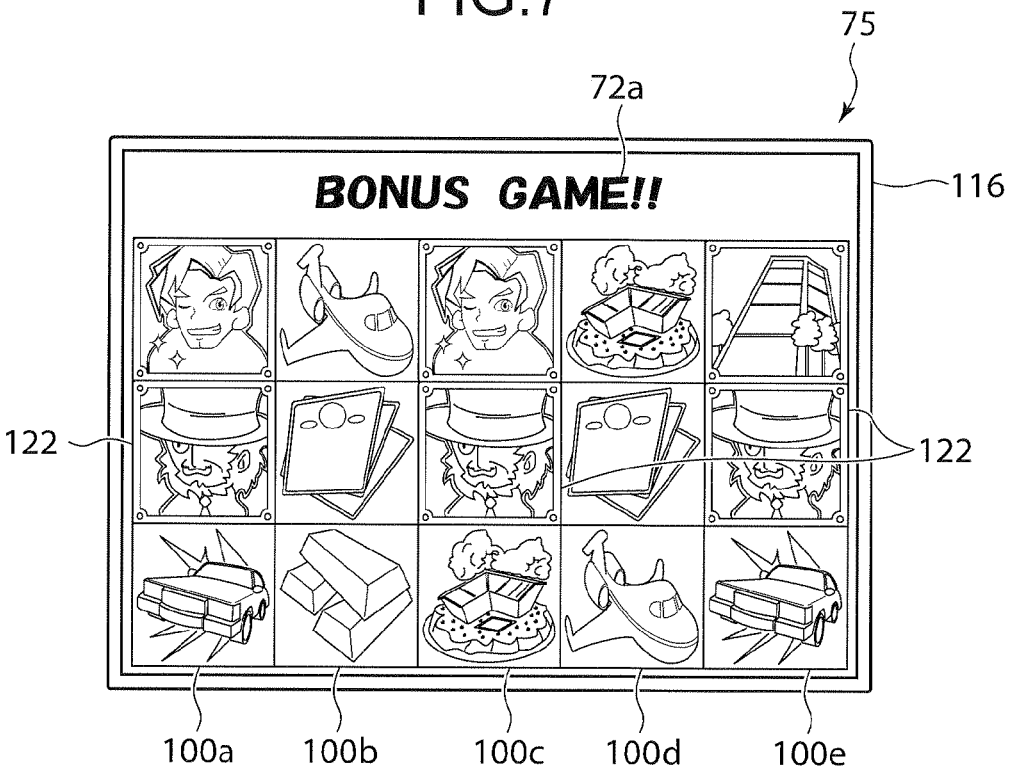
FIG. 7 is a view showing an exemplary image displayed during the bonus game in the common game machine.

FIG. 7 also shows an exemplary image rearranged in the symbol matrix of the common game machine 75 during the bonus game. The symbol matrix displays three bonus symbols "sub character 122", which meets the condition for establishment of the bonus prize, so that a jackpot is awarded. In this case, the jackpot is awarded to all of the slot machines that participate in this time's bonus game. The payout can be equally allocated to the respective slot machines but may be allocated in accordance with a cumulative number of bonus points possessed by each of the slot machines.

Figure 8:
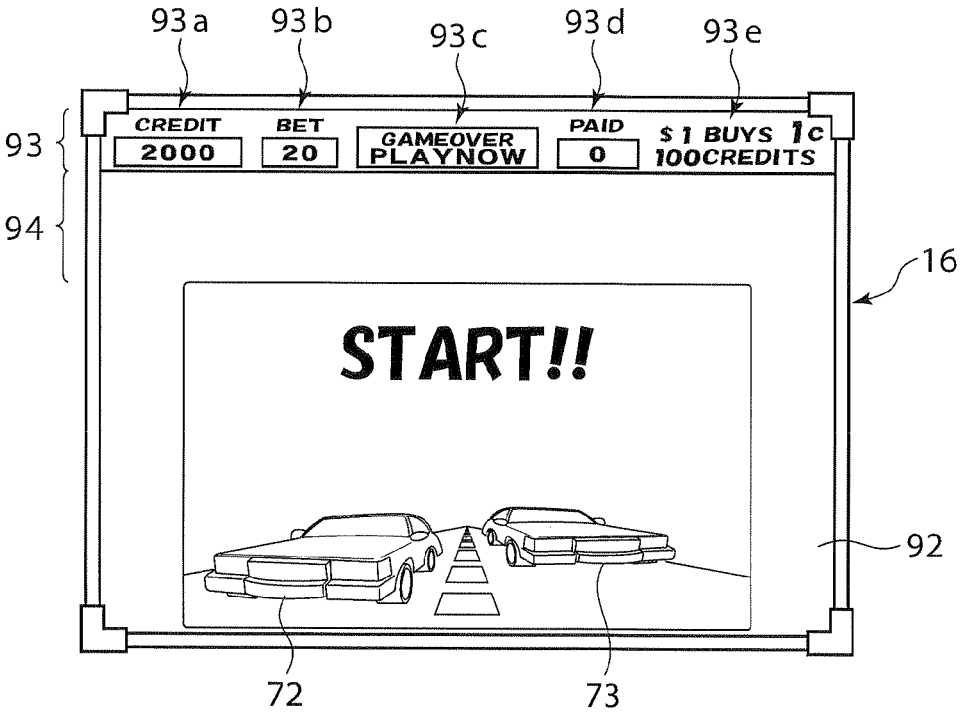
FIG. 8 is a view showing an exemplary image displayed during the bonus game in the slot machine shown in FIG. 2.
Figure 9A:
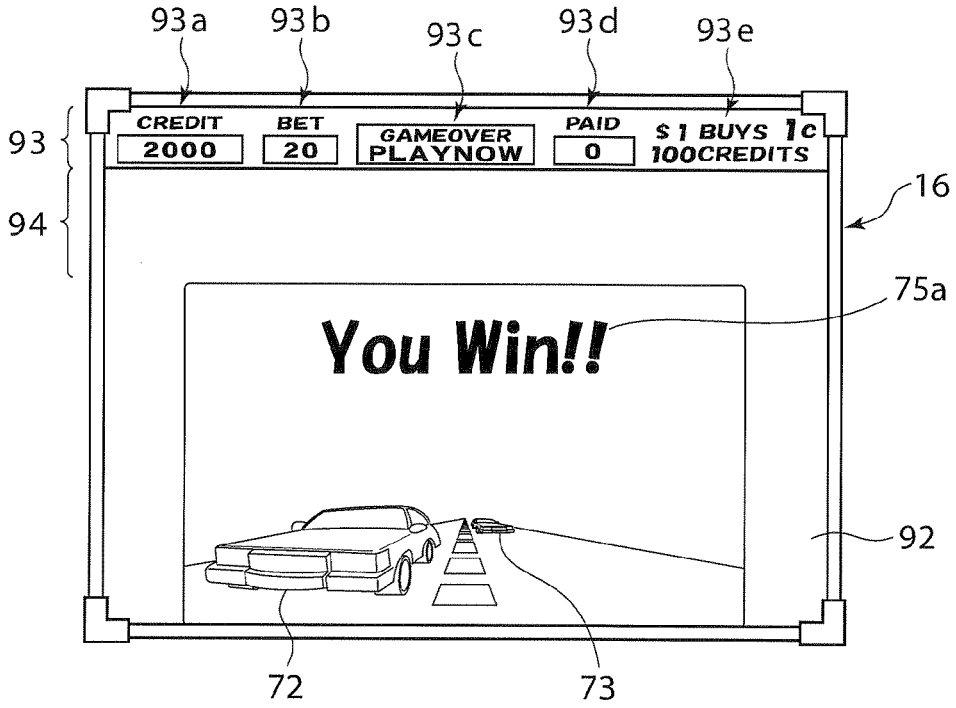
FIG. 9A is a view showing an exemplary image displayed during the bonus game in the slot machine shown in FIG. 2.
Figure 9B:
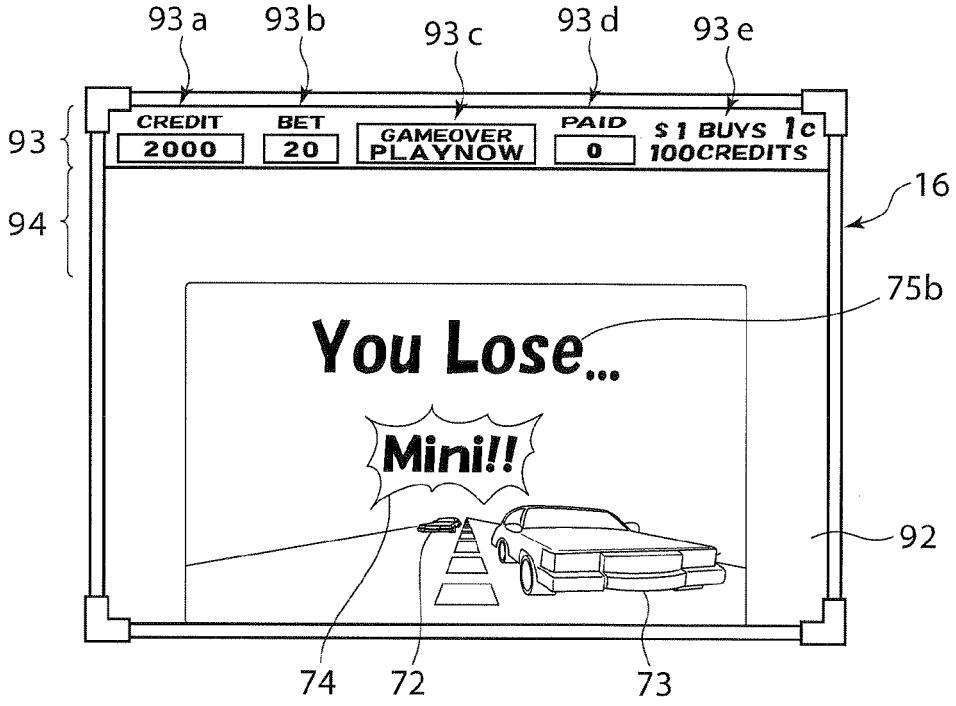
FIG. 9B is a view showing an exemplary image displayed during the bonus game in the slot machine shown in FIG. 2.

FIGS. 8 and 9 are views each showing an exemplary image displayed in the lower image display panel 16 of the slot machine 10 that wins the jackpot during the bonus game. The number of coins that are paid out in association with the jackpot is determined according to a cumulative value of credit stored in a predetermined region in the RAM 153 of the common game machine. The generally adopted method is that the jackpot is classified into three, i.e., "MIN", "MAJOR", and "MEGA" according to the cumulative value. In the case of a small cumulative value, the number of paid-out coins is small and the jackpot called "MIN" is awarded. On the other hand, in the case of both a cumulative value and the number of paid-out coins turn out large, the jackpot called "MAJOR" or "MEGA" is awarded. A screen shown in FIGS. 8 and 9 is displayed in order to indicate the payout amount according to the jackpot.

In FIG. 8, two cars are displayed in the display region 92 in the lower image display panel 16 of the slot machine 10 and a car race is started. Next, in FIG. 9A, a screen "WIN" is displayed in the display region 92. In the case of displaying this screen, the jackpot classified into "MAJOR" or "MEGA" is awarded. On the other hand, in the case of displaying a screen "LOSE" shown in FIG. 9B, the jackpot classified into "MIN" is awarded. The screen displayed in this manner enhances entertainability.

Next, a process executed in the slot machine 10 according to the first embodiment, will be described in detail with reference to the drawings. The main CPU 41 controls the progress of a game by reading out of the RAM 43 and executing the game program.

Figure 10:
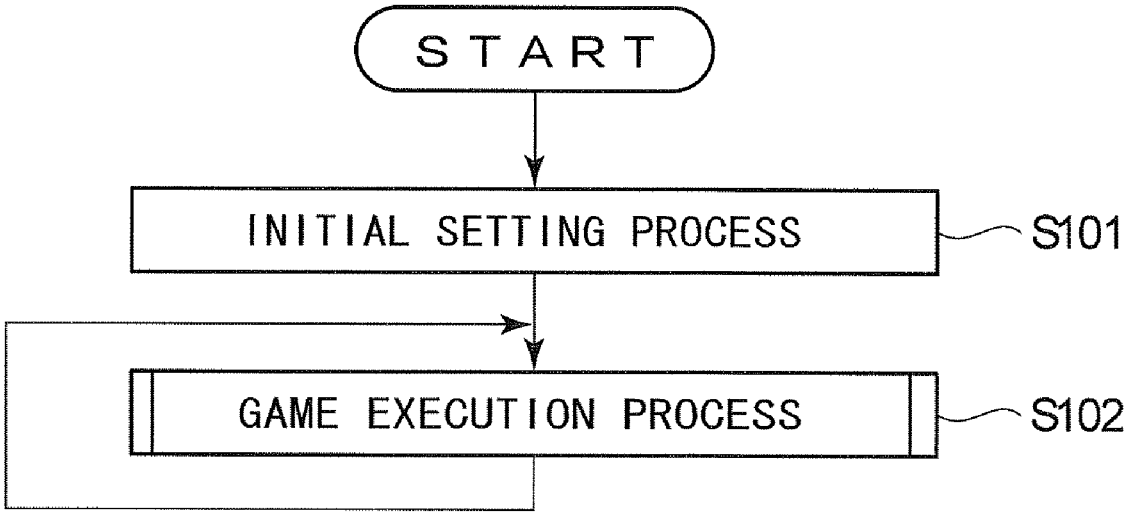
FIG. 10 is a flowchart showing a subroutine of a main process of the slot machine shown in FIG. 2.

FIG. 10 is a flowchart showing a subroutine of a main process. In the main process, first, when a power switch is turned on (that is, when power is supplied), a motherboard 40 and a gaming board 50 are activated respectively, so that the CPU 51 executes an initial setting process (step S101). In this initial setting process, the main CPU 41 executes the BIOS stored in the ROM 42, decompresses, in the RAM 43, compressed data included in the BIOS, executes the BIOS decompressed in the RAM 43, and performs diagnosis and initialization of each of the peripheral devices. The main CPU 41 writes game programs or the like from the memory card 53 into the RAM 43, and retrieves data for setting a payout ratio and country-identification information. The main CPU 41 also performs an authentication process for each program during execution of the initial setting process.

Next, the main CPU 41 performs a game execution process described later with reference to FIG. 8 (step S102). In this game execution process, the main CPU 41 sequentially reads and executes the game programs or the like from the RAM 43. By performing this game execution process, the slot machine according to the first embodiment 10 executes the game. The game execution process is repeatedly performed while power is supplied to the slot machine 10.

Figure 11:
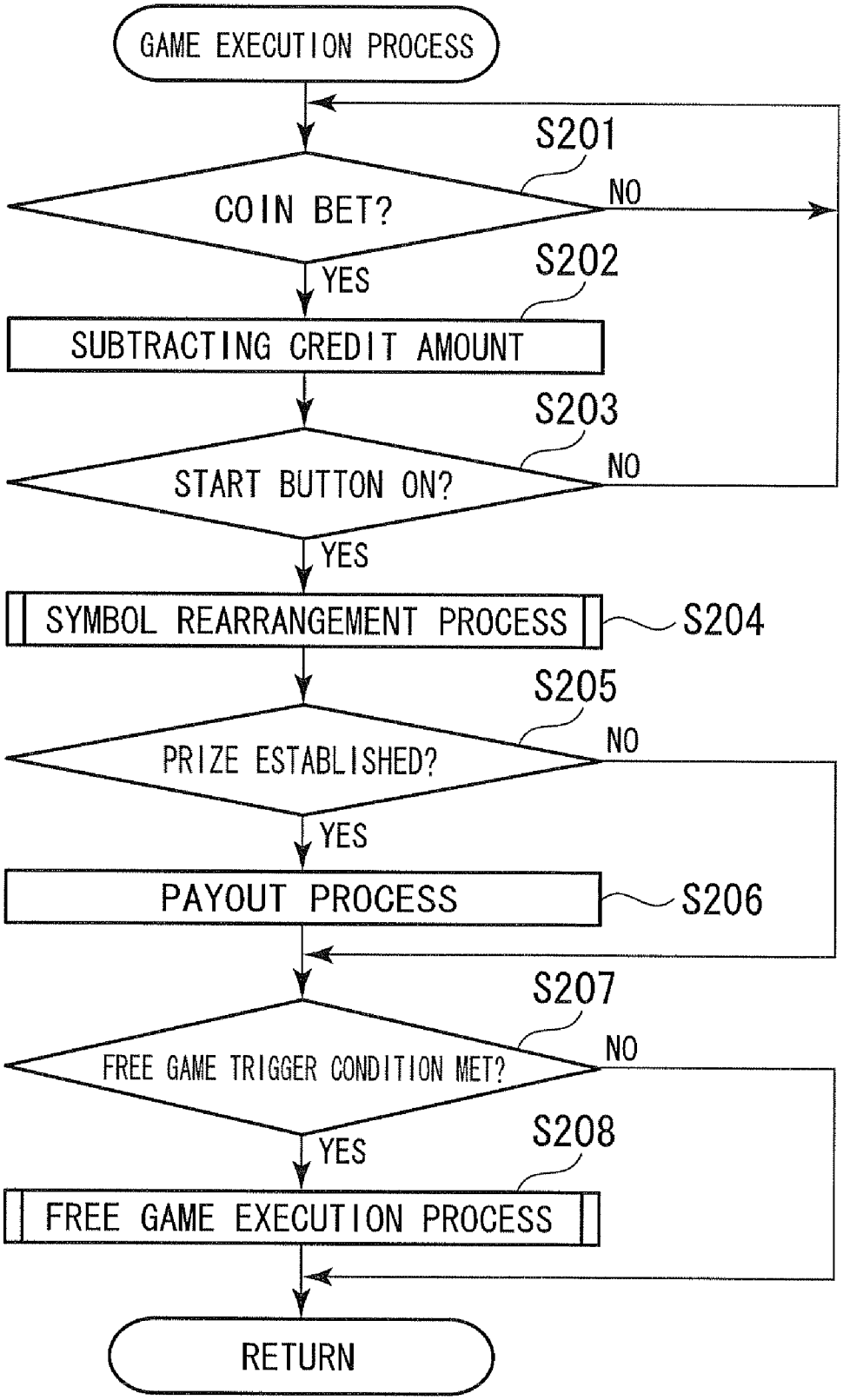
FIG. 11 is a flowchart showing a subroutine of a game execution process according to the slot machine shown in FIG. 2.

FIG. 11 is a flowchart showing a subroutine of the game execution process invoked and performed at step S102 of the subroutine shown in FIG. 10. First, the main CPU 41 judges whether a coin has been bet or not (step S201). Specifically, the main CPU 41 judges whether or an input signal has been received. The input signal is output from the 1-BET switch 26S at the time of operation of the 1-BET button 26 or output from the MAX-BET switch 27S at the time of operation of the MAX-BET button 27. The main CPU 41 controls the current step to return to the process at step S201 upon judging that no coin has been bet (step S201: NO).

Next, the main CPU 41 subtracts the number of bet coins from the credit amount stored in the RAM 43 (step S202) upon judging that a coin has been bet (step S201: YES). Where the number of bet coins is larger than the credit amount stored in the RAM 43, the main CPU 41 controls the current step to return to step S201 without performing the process for subtracting the number of bet coins from the credit number stored in the RAM 43. Where the number of bet coins exceeds the upper limit (50 coins in this embodiment) of coins that can be bet in one game, the main CPU 41 controls the step to return to step 201 without performing the process for subtracting the number of bet coins from the credit number stored in the RAM 43.

The main CPU 41 judges whether or not the start button 23 has been set to ON (step S203). Specifically, the main CPU 41 judges whether or not an input signal output from the start switch 23S at the time of pushing of the start button 23 has been received. The main CPU 41 controls the step to return to step 201 upon judging that the start button 23 has not been set to ON (step S203: NO). Where the start button 23 has not been set to ON (for example, where an instruction has been input to terminate the game without setting the start button 23 to ON), the main CPU 41 cancels acceptance of a subtraction result at step S202.

On the other hand, the main CPU 41 performs a symbol rearrangement process (step S204) upon judging that the start button 23 has been set to ON (step S203: YES). Specifically, the CPU 41 executes the program stored in the RAM 43 and determines the symbols to be rearranged in the symbol matrix. The symbols are selected from among the symbols, "main character 121", "sub character 122", "office building 123", "gold bullion 124", "car 125", "stock certificate 126", "jet 127", "villa 128", "CHANCE 70*a*", and "blank". This determination is based on the symbol weighting data and random numeric values sampled by sampling the random numeric values in a numerical range which comes under a predetermined range of random numeric values. The CPU 41 then rearranges the symbols in the symbol matrix.

Next, the main CPU 41 judges whether a prize has been established or not (step S205). Specifically, the main CPU 41 judges whether or not a combination of symbols rearranged in the symbol matrix 28 results in a winning combination allowed to award any of payouts. Herein, the prize is established on condition that the three or more symbols of the same type are rearranged in the symbol matrix 28.

Next, upon judging that the prize is established (step S205: YES), the main CPU 41 performs a predetermined coin-payout process (step S206). In the coin-payout process, the main CPU 41 transmits the control signal to the hopper 66 to pay out the predetermined amount of coins. The CPU 41 may control the process to add the credit corresponding to the coins to be paid out to the credit amount stored in the RAM 43.

Next, the CPU 41 judges whether a free game trigger condition has been met or not (step S207) when judging that the prize is not established (step S205: NO) or after executing the payout process at step S206. Specifically, the main CPU 41 executes the program stored in the RAM 43 to sample the random numeric values in a numerical range which comes under a predetermined range of random numeric values, thereby judging whether or not the symbol "main character 121" is rearranged based on the sampled random numeric values. The main CPU 41 then counts the number of the rearranged symbols "main character 121" and judges that the free game trigger condition is met when the three or more symbols "main character 121" are rearranged. The main CPU 41 performs the free game execution process (step S208) when judging that the free game trigger condition is met (step S207: YES). In this free game execution process, the main CPU 41 reads and executes game programs or the like out of the RAM 43 in sequence, thereby executing the free game execution process. On the other hand, the main CPU 41 terminates the game execution process when judging that the free game trigger condition is not met at step S207 (step S207: NO) or when executing the process at step S208.

Figure 12:
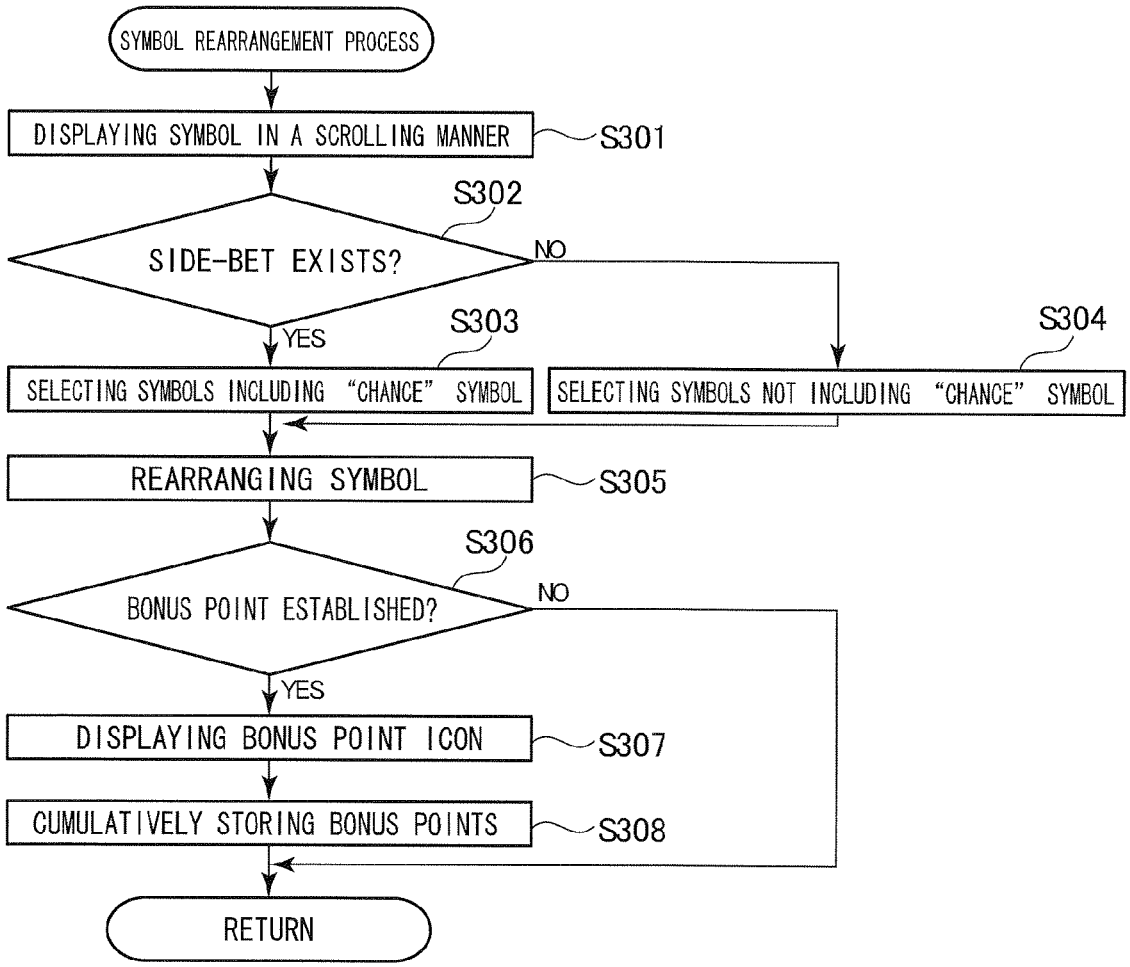
FIG. 12 is a flowchart showing a subroutine of a basic game rearrangement process according to the slot machine shown in FIG. 2.

FIG. 12 is a flowchart showing a subroutine of a symbol rearrangement process which is invoked and executed at step S204 of the subroutine shown in FIG. 11. First, the main CPU 41 displays the symbols in a scrolling manner (step S301). Specifically, the main CPU 41 executes the program stored in the RAM 43 to perform virtual display of an effect image that is virtually recognized as if the symbols are scrolled at high speed in a downward direction of a column of the symbol matrix.

The main CPU 41 then judges whether the side-BET button 85 has been set to ON or not (step S302). Specifically, the main CPU 41 judges whether or not the input signal has been received, the signal being output from the side-BET switch 90S when the side-BET button 85 is pressed. Upon judging that the side-BET button 85 has been set to ON (step S302: YES), the main CPU41 executes a process at step S303. Upon judging that the side-BET button 85 has not been set to ON (step S302: NO), the main CPU 41 executes a process at step S304.

At step S303, the main CPU 41 selects a group of symbols containing the symbol "CHANCE 70*a*" from among a plurality of groups of symbols stored in the RAM 43. On the other hand, the CPU 41 selects the group of symbols not containing the symbol "CHANCE 70*a*" from among the plurality of groups of symbols stored in the RAM 43. In this manner, control is performed to rearrange the symbol "CHANCE 70*a*" in the symbol matrix 28 only when the side-BET has been placed.

The main CPU 41 then rearranges the symbols selected at step S303 or step S304, in the symbol matrix (step S305). Specifically, the main CPU 41 executes the program stored in the RAM 43 to compare a numeric value determined based on each symbol weighting data to a random numeric value generated correspondingly to each cell of the symbol matrix 28, thereby determining the symbol to be arranged in each cell of the symbol matrix, from among the group of symbols selected at step S303 or S304. The main CPU 41 then rearranges the determined symbols.

Next, the main CPU 41 makes a judgment as to whether or not the symbol "CHANCE 70*a*" is contained in the symbols rearranged in the symbol matrix at step S305. In the case where the symbol "CHANCE 70*a*" is not contained, the main CPU 41 terminates the symbol rearrangement process (step S306: NO). Where the symbol "CHANCE 70*a*" is contained in the symbols rearranged in the symbol matrix 28, the main CPU 41 counts the number of symbols "CHANCE 70*a*". Upon judging that three or more symbols "CHANCE" are contained (step S306: YES), the main CPU 41 causes the effect image display section 94 to display an effect image that one more icon "BONUS" is added (step S307).

The main CPU 41 then invokes a cumulative value of bonus points stored in the RAM 43, the value being equal to the number of icons "BONUS 70*d*" having been displayed by the time of the previous symbol rearrangement process. The main CPU 41 adds one to the value and then stores it again in the RAM 43 (step S308). The main CPU 41 terminates the symbol rearrangement process throughout the above described process.

FIG. 13 is a flowchart showing a bonus game execution process executed in the common game machine 75. First, the CPU 151 as the common controller of the common game machine 75 receives information on a cumulative number of bonus points stored in a predetermined region in the RAM 43, from the main CPU 41 of each of the slot machines, and then judges whether to execute the bonus game (step S401). Specifically, the CPU 141 judges whether or not there is a slot machine in which a cumulative number of bonus points reaches five. The CPU 151 terminates the subroutine upon judging that a cumulative number of each of the slot machine is smaller than five (step S401: NO). On the other hand, upon judging that there is a slot machine possessing a cumulative value equal to five (step S401: YES), the CPU 151 shifts the current step to the process for executing the bonus game.

The CPU 151 receives the information on a cumulative number of bonus points stored in the predetermined region in the RAM 43, from the main CPU 41 of each of the slot machines, and then selects a slot machine possessing a cumulative value of bonus points not equal to zero (step S402).

Next, the CPU 151 displays an effect image for start of the bonus game in the display device 116 (step S403: see FIG. 5B).

After setting the start button 23 to ON in each of the slot machines, the CPU 151 designates a column displayed in the symbol matrix of the display device 116 and receives information on symbols to be rearranged in the designated column from the CPU 41 of each of the slot machines (step S404). At this step, in the case where the number of slot machines that are allowed to participate in the bonus game is smaller than five and the symbol matrix with three rows and five columns cannot be configured, the CPU 151 designates the symbol matrix 28 of each of the slot machines that do not participate in the bonus game, and receives information on symbols to be rearranged in the designated column from each of the CPUs 41 of those slot machines.

Upon receipt of information on symbols from the main CPU 41 of each of the slot machines, the CPU 151 rearranges the symbols in the symbol matrix of the display device 116 (step S405). At this step, the CPU 151 provides an instruction regarding a timing of rearrangement to the CPU 41 of each of the slot machines from which the CPU 151 received the information on symbols. The CPU 151 is then synchronized with each of the slot machines.

The CPU 151 then judges whether or not a bonus prize has been established (step S406). Specifically, the main CPU 41 judges whether or not three or more bonus symbols "sub character 122" are rearranged in the symbol matrix 28 (see FIG. 7). Upon judging that the bonus prize has been established (step S406: YES), the main CPU 41 performs a jackpot process (step S408). Specifically, the CPU 151 receives from the main CPU 41 of each of the slot machines 10*a* to 10*e*, information on a cumulative value of credit cumulatively stored in the memory region set in the RAM 43 of each of those slot machines 10*a* to 10*e*, and then performs a payout process of coins, the number of which is determined based on a sum total of the received cumulative values (step S506: see FIG. 14). On the other hand, upon judging that the bonus prize has not been established (step S406: NO), the CPU 151 shifts the current step to the process for judging as to establishment of another prize (step S407).

The main CPU 151 then judges whether or not the condition for awarding the prize has been established (step S407). Specifically, the CPU 151 judges whether or not three or more symbols are rearranged in the symbol matrix 28 of the display device 116 (see FIG. 6B). Upon judging that the prize has been established (step S407: YES), the CPU 151 then instructs the main CPU 41 of each of the slot machines to pay out the corresponding number of coins to each prize (step S409).

On the other hand, upon judging that the prize has not been established (step S407: NO) and executing a process at step S409, the CPU 151 instructs the main CPU 41 of each of the slot machines to subtract one from a cumulative value of bonus points stored in the RAM 43 (step S410).

Next, the CPU 151 receives information on a cumulative value of bonus points stored in the RAM 43 from the main CPU 41 of each of the slot machines 10*a* to 10*e*, and judges whether or not there is a slot machine that possesses a cumulative value of bonus points not equal to zero, the value being stored in the RAM43. Upon judging that there is a slot machine that possesses a cumulative value not equal to zero (step S411: YES), the CPU 151 controls the current step to return to the process at step 402. On the other hand, upon judging that all slot machines possess a cumulative value of bonus points equal to zero (step S411: NO), the main CPU 151 terminates a subroutine.

Figure 14:
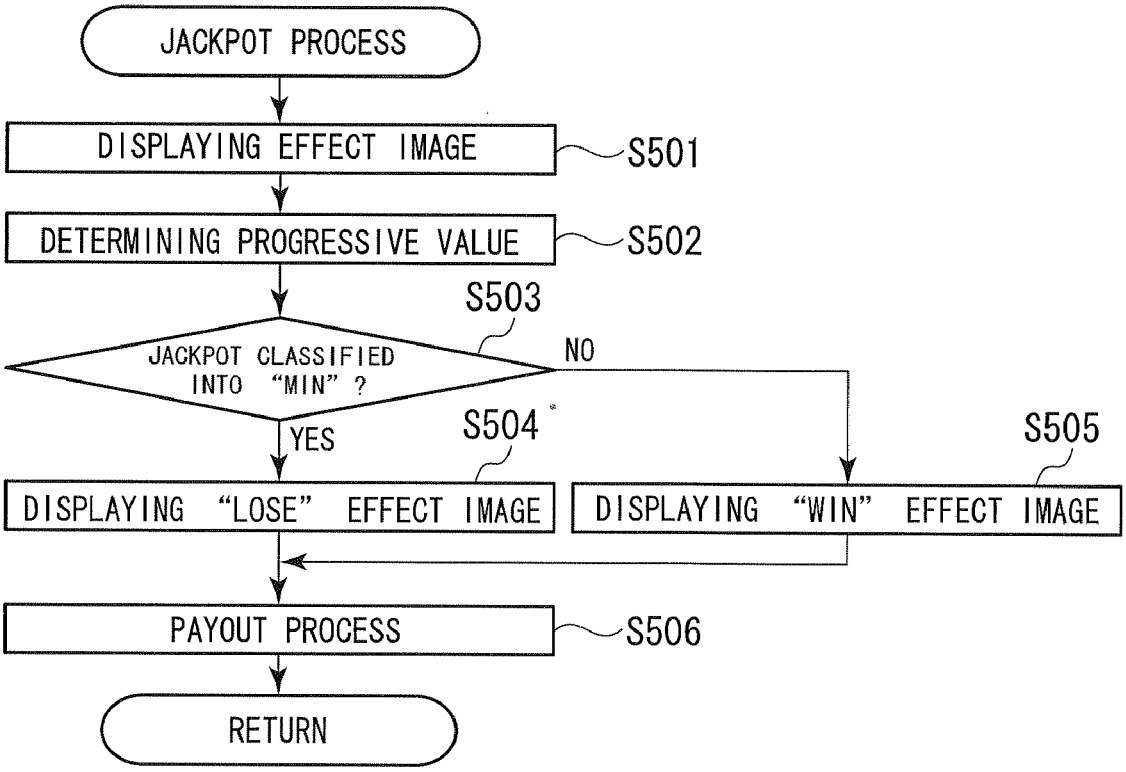
FIG. 14 is a flowchart showing a subroutine of a jackpot process of the common game machine.

FIG. 14 is a flowchart of the jackpot process invoked and executed at step S408 of the subroutine shown in FIG. 13. First, the CPU 151 instructs the main CPU 41 of each pf the slot machines participating in the bonus game to display in the display region 92 of the lower image display panel 16 an effect image (see FIG. 8) indicating that the bonus prize has been established and the jackpot is to be paid out (step S501).

Next, the CPU 151 receives from the main CPU 41 of each of the slot machines 10*a* to 10*e*, information on a cumulative value of credit stored in the RAM 43. The CPU 151 then sums the above cumulative vales and stores the sum total in a predetermined region in the RAM 153 of the common game machine 75. The CPU 151 then judges the amount of the jackpot, based on the sum total value (step S502). Specifically, the CPU 151 determines into which of "MIN", "MAJOR", and "MEGA" the jackpot is classified, the jackpot being paid out based on a cumulative value of credit.

The CPU 151 judges whether or not the jackpot to be paid is classified into "MIN" (step S503). In the case of the jackpot being classified into "MIN", the CPU 151 instructs the main CPU 41 of each of the slot machines participating in the bonus game to display in the display region 92 of the lower image display panel 16 an effect image of "LOSE" (see FIG. 9B) indicating that the jackpot of "MIN" is to be paid out (step S504). On the other hand, where the jackpot is classified into either one of "MAJOR" and "MEGA", the CPU 151 instructs the main CPU 41 to display in the display region 92 of the lower image display panel 16 an effect image of "WIN" (see FIG. 9A) indicating that the jackpot of "MAJOR" or "MEGA" is to be paid out (step S505).

Next, the CPU 151 instructs the main CPU 41 of each of the slot machines participating in the bonus game to pay out the jackpot (step S506). In this case, the jackpot is awarded to all of the slot machines participating in the bonus game. The payout can be equally allocated to the respective slot machines but may be allocated in accordance with a cumulative number of bonus points possessed by each of the slot machines. In the case where the coins are deposited, the main CPU 41 performs a process for adding the number of paid-out coins to the credit amount stored in the RAM 43. In the case where the coins are paid out, the main CPU 41 pays out the predetermined number of coins by transmitting the control signal to the hopper 66.

In the foregoing, while the embodiments of the present invention have been described, these embodiments merely present specific examples. An appropriate design change can be made for the specific configuration of each means or the like. Also, the effects described in the embodiments of the present invention are only listing the most preferable effects arising from the present invention, and the effects of the present invention are not limited to those described in the embodiments of the present invention.

What is claimed is:

1. A game system, comprising:

a plurality of slot machines; and a common game machine for executing a predetermined bonus game in connection with a base game executed among the plurality of slot machines, each of the plurality of slot machines having:

an input device for accepting BET;

a display device having a symbol display region for displaying plural types of symbols in a matrix form;

a memory for cumulatively storing bonus points in the case where a specific symbol from among the plural types of symbols is rearranged in the symbol display region under a specific condition; and a controller for executing processes for accepting the BET input through the input device, rearranging the plural types of symbols in the symbol display region of the display device, and cumulatively storing the bonus points in the memory, the common game machine having:

a common display device provided in common to the plurality of slot machines, the common display device having a symbol display region for displaying plural types of symbols in a matrix form;

a common memory for cumulatively storing a part of credit bet through the input device; and a common controller being adapted to execute processing operations of:

selecting the slot machine possessing the bonus points;

in respect of the selected slot machine, executing the bonus game to simultaneously advance at a same time as a base game at each of the slot machines on the common display device;

in the bonus game, randomly determining a specific column or line at a part of a matrix displayed on each of the display devices of the plurality of slot machines in the base game, and rearranging the symbols to be displayed in the determined specific column or line on the common display device so that the specific line or column at the part of the matrix display of each of the determined slot machines is formed as each of columns or lines in a symbol display region of the common display device;

subtracting a predetermined number from the bonus points stored in the memory of each of the slot machines, every time the bonus game is executed; and awarding a prize determined based on a cumulative value of the credit stored in the common memory, in the case where a predetermined condition is met during the bonus game.

2. The game system according to claim 1, wherein:

the common controller supervises bonus points that are stored in a memory of each of the slot machines, and selects the slot machine having the bonus point for executing a bonus game in a case where the number of bonus points that is stored in the memory of each of the slot machines reaches a predetermined value.

3. The game system according to claim 1, wherein:

the common controller determines allotment of payout to each of the plurality of slot machines, based on a cumulative value of the bonus points stored in each of the memories.

4. A game system, comprising:

a plurality of slot machines; and a common game machine for executing a predetermined bonus game in connection with a base game executed among the plurality of slot machines, each of the plurality of slot machines having:

an input device for accepting BET;

a display device having a symbol display region for displaying plural types of symbols in a matrix form;

a memory for cumulatively storing bonus points in the case where a specific symbol from among the plural types of symbols is rearranged in the symbol display region under a specific condition; and a controller for executing processes for accepting the BET input through the input device, rearranging the plural types of symbols in the symbol display region of the display device, and cumulatively storing the bonus points in the memory;

the common game machine having:

a common display device provided in common to the plurality of slot machines, the common display device having a symbol display region for displaying plural types of symbols in a matrix;

a common memory for cumulatively storing a part of credit bet through the input device; and a common controller being adapted to execute processing operations of:

selecting the slot machine possessing the bonus points;

in respect of the selected slot machine, executing the bonus game to simultaneously advance at a same time as the base game at each of the slot machines on the common display device;

in the bonus game, randomly determining a specific column or line at a part of a matrix displayed on each of the display devices of the plurality of slot machines in the base game, and rearranging the symbols to be displayed in the determined specific column or line on the common display device so that the specific line or column at the part of the matrix display of each of the determined slot machines is formed as each of columns or lines in a symbol display region of the common display device;

subtracting a predetermined number from the bonus points stored in the memory of each of the slot machines, every time the bonus game is executed; and determining allotment of payout based on a cumulative value of the bonus points stored in each of the memories, in the case where a specific condition is met during the bonus game.

5. The game system according to claim 4, wherein:

the common controller supervises bonus points that are stored in a memory of each of the slot machines, and selects the slot machine having the bonus point for executing a bonus game in a case where the number of bonus points that is stored in the memory of each of the slot machines reaches a predetermined value.

6. A game system, comprising:

a plurality of slot machines; and a common game machine for executing a predetermined bonus game in connection with a base game executed among the plurality of slot machines, each of the slot machines having:

an input device for accepting BET;

a display device having a symbol display region for displaying plural types of symbols in a matrix form;

a memory for cumulatively storing bonus points in the case where a specific symbol from among the plural types of symbols is rearranged in the symbol display region under a specific condition; and a controller for executing processes for accepting the BET input through the input device, rearranging the plural types of symbols in the symbol display region of the display device, and cumulatively storing the bonus points in the memory;

the common game machine having:

a common display device provided in common to the plurality of slot machines, the common display device having a symbol display region for displaying plural types of symbols in a matrix form;

a common memory for cumulatively storing a part of credit bet through the input device; and a common controller being adapted to execute processing operations of:

selects the slot machine possessing the bonus points, in a case where the number of bonus points that is stored in the memory of each of the slot machines reaches a predetermined value;

executing the bonus game on the common display device;

in respect of the selected slot machines, executing the bonus game to simultaneously advance at a same time as a base game at each of the slot machines on the common display device;

in the bonus game, randomly determining a specific column or line at a part of a matrix displayed on each of the display devices of the plurality of slot machines in the base game, and rearranging the symbols to be displayed in the determined specific column or line on the common display device so that the specific column or line at the part of the matrix display of each of the determined slot machines is formed as each of columns or lines in a symbol display region of the common display device;

subtracting a predetermined number from the bonus points stored in the memory of each of the slot machines, every time the bonus game is executed; and determining allotment of payout based on a cumulative value of the bonus points stored in each of the memories, in the case where a specific condition is met during the bonus game.

* * * * *